United States Patent [19]

Samuelson et al.

[11] Patent Number: 4,750,973

[45] Date of Patent: Jun. 14, 1988

[54] PROCESS FOR REDUCING CARBOHYDRATE LOSSES IN THE SULFATE PULPING OF WOOD BY PRETREATING THE WOOD WITH OXYGEN AND NITROGEN OXIDES

[75] Inventors: Hans O. Samuelson, Gothenburg; Erik O. S. Hagglund, Domsjo, both of Sweden

[73] Assignee: Mo och Domsjo Aktiebolag, Ornskoldsvik, Sweden

[21] Appl. No.: 436,864

[22] Filed: Oct. 26, 1982

[30] Foreign Application Priority Data

Oct. 27, 1981 [SE] Sweden ..... 8106326

[51] Int. Cl.[4] ..... D21C 3/02; D21C 3/16

[52] U.S. Cl. ..... 162/65; 162/81; 162/82

[58] Field of Search ..... 162/63, 65, 81, 19, 162/90, 82

[56] References Cited

U.S. PATENT DOCUMENTS

| | | | |
|---|---|---|---|
| 2,110,546 | 3/1938 | Dreyfus | 162/81 |
| 2,733,992 | 2/1956 | Reyerson | 162/63 |
| 4,076,579 | 2/1970 | Brink | 162/63 |

*Primary Examiner*—Steve Alvo

[57] ABSTRACT

A process is provided for reducing carbohydrate losses in the sulphate pulping of wood using sodium hydroxide and sodium sulfide, by pretreating the wood in the presence of water with oxygen gas and nitrogen oxide such as $NO_2$ and/or NO and/or polymeric oxides and double molecules thereof, for example, $N_2O_4$ or $N_2O_3$, for from about 3 to about 110 minutes at a temperature within the range from about 25° to about 100° C., the amount of nitrogen oxide charged, calculated as monomers, being within the range from about 0.05 to about 1 kilomole per 1000 kg bone-dry wood, resulting in one or several of the following advantages: an improved yield of pulp, an improved viscosity, and a reduced requirement for bleaching chemicals in any subsequent bleaching stages.

19 Claims, No Drawings

PROCESS FOR REDUCING CARBOHYDRATE LOSSES IN THE SULFATE PULPING OF WOOD BY PRETREATING THE WOOD WITH OXYGEN AND NITROGEN OXIDES

Digestion of wood using the sulphate pulping method produces a yield of wood pulp of about 45% in the case of softwood, and over 50% in the case of hardwood. The ever increasing shortage of wood has led to a search for digestion methods which will result in a cellulose pulp in high yield and with good strength properties. Attempts therefore have been made to increase the yield with additives such as polysulphide and anthraquinone, but the effect of these additives is often small, however, unless very large quantities are used.

Andersson, Bergstrom and Hartler, Swedish patent No. 309,530, suggest that the pulp yield in the sulfate pulping of softwood can be increased considerably if the digestion is carried out in two stages. First, the wood is subjected to pretreatment with a sodium hydrosulfide solution at elevated temperature, and then the wood is pulped using a pulping liquor containing sodium hydroxide and sodium sulfide. However, sodium hydrosulfide solution has a high partial pressure of hydrogen sulfide, especially at elevated temperatures, and consequently, because of the toxicity of hydrogen sulfide, the preparation and handling of sodium hydrosulfide solutions in a pulp mill pose very difficult problems, particularly from the standpoint of safety. Consequently, this process has not been applied on a commercial scale.

Day and Hoos, Swedish patent No. 167,779, suggest that the yield of cellulose pulp can be increased considerably in a sulfate pulping process if the wood is subjected to pretreatment with hydrogen sulfide gas prior to alkaline digestion with sodium hydroxide in the presence of sodium sulfide.

Vinje and Worster, Swedish patent No. 315,189, U.S. Pat. No. 3,520,773, patented July 14, 1970, propose a modification of this process by carrying out the pretreatment in the presence of an alkaline buffer solution.

Here, also, however, the preparation and handling of toxic hydrogen sulfide gas under pressure, and its introduction into the pulping system, pose a considerable safety hazard, and consequently these processes have not been applied commercially, either.

Procter, Styan and Vinje, Swedish Ultlagningsskrift No. 73 10326-9, U.S. Pat. No. 3,841,962, patented Oct. 15, 1974, propose the preparation of hydrogen sulfide during the pretreatment by reaction of a liquid having a high sulfidity, such as a liquid containing sodium sulfide, with an excess of gaseous carbon dioxide. Unless the carbon dioxide is pure, rather high pressures in the digester result, in order to achieve the necessary partial pressure of hydrogen sulfide, and operation at high pressures of course increases the risk of escape of hydrogen sulfide from the system. Moreover, this requires the preparation of carbon dioxide, and the production of carbon dioxide, particularly pure carbon dioxide, is rather expensive.

Samuelson, U.S. Ser. No. 330,406, filed Dec. 14, 1981, provides a process for delignifying bleaching chemical cellulose pulp comprising contacting the pulp in an activation stage in the presence of water with a gas phase containing NO2 and oxygen gas, so that intermediary NO is utilized for activating the pulp, followed by an alkali treatment of the pulp; both the activation stage and alkali treatment are carried out under drastic conditions, at such a high temperature during the activation stage that a certain degradation of the cellulose molecules is obtained, and at a temperature of 95° to 150° C. during the alkali treatment over a treatment time exceeding 45 minutes at 95° C.

Samuelson, U.S. Ser. No. 358,998, filed Mar. 17, 1982, and now abandoned, provides a process for removing residual lignin while maintaining good pulp quality in cellulose pulp produced by chemically pulping lignocellulosic material, which comprises contacting the cellulose pulp in an activating stage in the presence of water with a gas phase containing $NO_2$ and oxygen gas at a temperature within the range from about 40° to about 100° C. sufficient to obtain a degration of the cellulose molecules resulting in a reduction in the intrinsic viscosity of the cellulose pulp during the activation stage within the range from about 2 to about 35% compared to the intrinsic viscosity prior to the activation; and then subjecting the pulp to an oxygen gas-alkali treatment at a temperature within the range from about 80° to about 150° C. at an oxygen partial pressure within the range from about 0.005 to about 0.18 MPa.

Samuelson, U.S. Ser. No. 361,289, filed Mar. 24, 1982, provides a process for activating cellulose pulp using NO and/or $NO_2$ plus oxygen gas in the presence of nitric acid, added in an amount within the range from about 0.1 to about 1.0 g mole per kg of water accompanying the cellulose pulp at a temperature within the range from about 40° to about 120° C. for a time at an activating temperature of 40° to 50° C. of from 15 to 180 minutes, at from 50° to 90° C. of from 5 to 120 minutes, and at higher temperatures of from 1 to 10 minutes, followed by washing, and delignifying bleaching in an alkaline medium with or without oxygen gas and/or peroxide.

The use of nitrogen oxides in delignification of lignocellulosic material such as wood using sodium hydroxide has also been suggested, but the method has not found practical use, for environmental reasons, and because of the large quantities of nitrogen oxides consumed and the difficulty in maintaining the viscosity of the pulp at an acceptable level, with resultant impaired strength properties in the paper produced from such pulp.

In accordance with the invention, a process is provided for reducing carbohydrate losses in the sulphate pulping of wood using sodium hydroxide and sodium sulfide, by pretreating the wood in the presence of water with oxygen gas and nitrogen oxide such as $NO_2$ and/or NO and/or polymeric oxides and double molecules thereof, for example, $N_2O_4$ or $N_2O_3$, for from about 3 to about 110 minutes at a temperature within the range from about 25° to about 100° C., the amount of nitrogen oxide charged, calculated as monomers, being within the range from about 0.05 to about 1 kilomole per 1000 kg bone-dry wood, resulting in an improved yield of pulp, an improved viscosity, and a reduced requirement for bleaching chemicals in any subsequent bleaching stages.

The water can be present during the pretreatment as water absorbed by the wood before contact with nitrogen oxide, in which case the wood has a moisture content of from about 20 to about 60%, suitably from about 25 to about 55%, preferably from about 35 to about 52%. The nitrogen oxide is charged in a quantity, calculated as monomer, of from about 0.05 to about 1, suitably from about 0.1 to about 0.8, preferably from about 0.3 to about 0.6 kilomole per 1000 kg of bone-dry wood, and the pretreatment process effected for a period of from about 3 to about 110 minutes, preferably from about 5 to about 90 minutes at a temperature of from about 25° to about 100° C., suitably from about 52° to about 95° C., preferably from about 56° to about 85° C.

The process should be so controlled that upon completion of the pretreatment at least 40 mole %, suitably at least 50 mole %, preferably at least 60 mole % of the nitrogen oxides charged, calculated as monomer, is present in the form of nitric acid and/or nitrate salt.

Following the pretreatment, a conventional sulphate cooking process is carried out. It has been found particularly suitable to work with an aqueous pulping liquor composed of sodium hydroxide and sodium sulfide of low sulphidity, for example, a sulphidity of from about 10 to about 30%, preferably from about 15 to about 25%. The process of the invention can be applied to advantage in combination with polysulphide pulping, i.e., sulphate cooking with a pulping liquor containing polysulphide. It is of interest to note that the effects afforded by the method can also be achieved when pulping is effected with an addition of a redox catalyst, for example, anthraquinone.

The combined pretreatment and sulfate pulping process of the invention is applicable to all kinds of softwood and hardwood. Softwoods such as spruce, fir, pine, cedar, juniper and hemlock can be pulped satisfactorily using this process. Exemplary hardwoods which can be pulped include birch, beech, poplar, cherry, sycamore, hickory, ash, oak, chestnut, aspen, maple, alder and eucalyptus.

The wood should be in particulate form. Wood chips having dimensions that are conventionally employed in the sulfate process can be used. Sawdust, wood flour, silvers, scobs, splinters, wood granules and wood chunks and other types of wood fragments can also be used.

In the state at which it arrives at the cellulose plant, in the form of logs or chips, the wood normally is wet or moist, and has a solids content of from about 40 to about 60%, often from about 45 to about 55%, i.e., a moisture content of from about 40% to about 60%, often 45 to 55%. It is not necessary to dry the wood, since the pretreatment is carried out in the presence of water, and water already absorbed by the wood can serve. An impaired effect may be obtained in the pretreatment if the wood is dried before or subsequent to the preparation of chips. If drying is carried out to an extent such that the solids content exceeds 80%, i.e., the moisture content is less than 20%, the pulp yield is greatly impaired, while the viscosity obtained is lower than that obtained when the solids content lies within the range from about 48 to about 65%, and the moisture content between about 35 and about 52%. A certain amount of drying, for example to a solids content from about 55 to about 70%, during storing of the wood, for example, in the form of chips, can be tolerated. If the moisture content falls below 20%, however, water has to be added before or during the pretreatment, in an amount sufficient to bring it to at least 20% up to about 55%.

It has been found suitable to react the nitrogen oxide charged in the pretreatment with the wood constituents, for example with the lignin and carbohydrates, and with the moisture contained in the wood, in a manner such that at least 40 mole %, suitably at least 50 mole %, preferably at least 60 mole % of the nitrogen oxide charged is present upon completion of the pretreatment, in the form of nitric acid and/or nitrate salt which can be washed out. The presence of nitric acid and/or nitrate salt is determined after washing the wood with warm water, so that any unstable nitric acid esters present are decomposed to give nitric acid. Part of the nitric acid formed reacts with the metallic ash constituents of the wood, and gives rise to metal nitrates, for example, calcium, magnesium and manganese nitrates. Thus, the aforementioned figures give the sum of the nitric acid and nitrates that are washed out.

The conditions applied in the pretreatment are adapted to the quality and moisture content of the wood, and to the purpose for which the cellulose pulp is to be used. It has been found that to obtain a high pulp yield, the conditions applied when pretreating softwood should be much more severe than those applied when pretreating hardwood. Treatment for from about 3 to about 110 minutes at from about 25° to about 100° C. includes conditions which are suitable for both softwood and hardwood. The temperature range of from about 25° to about 52° C. is quite suitable for hardwood; for softwood, suitable temperatures are from about 52° to about 95° C., preferably from about 56° to about 85° C. If a relatively high temperature, for example, a temperature of 56° C., is selected when pretreating hardwood, the treatment time should be kept to about 30 minutes or less.

The term "nitrogen oxide" as used herein includes NO, $NO_2$, and polymers and double molecules thereof such as $N_2O_4$ and $N_2O_3$, and mixtures of any two or more thereof.

Nitrogen dioxide is a highly reactive nitrogen oxide and can be charged as substantially pure $NO_2$, or can be permitted to form in the reactor by supplying nitric oxide (NO) and oxygen thereto. In contrast to $NO_2$, NO is substantially inert, although it will react with the wood material if oxygen is present. $NO_2$ plus NO can also be charged. One mole of dinitrogen tetroxide is calculated as two moles of nitrogen dioxide. Adducts in which nitric oxide is present are calculated in the same manner as nitric oxide. Thus, dinitrogen trioxide ($N_2O_3$) is calculated as one mole nitric oxide and one mole nitrogen dioxide. Adducts containing oxygen are probably also present, as intermediates.

The amount of nitrogen oxides charged is adapted according to the lignin content, the extend of delignification desired, and the extent to which attack on the carbohydrates can be tolerated.

A given quantity of oxygen gas must be supplied to the activating stage both when adding nitrogen dioxide ($NO_2$) and when adding nitric oxide (NO). Pure oxygen can be used, as well as an oxygen-containing gas, such as air.

In order to obtain the best possible result with the simplest of apparatus, oxygen is preferably supplied to the activating stage in the form of substantially pure oxygen gas. Liquid oxygen can also be charged, and gasified, for example, when entering the reactor in which the activating process is carried out. When using substantially pure oxygen, less $NO+NO_2$ is present in the gas phase than when using air. This also means that only a minor quantity of inert gas needs to be removed from the reactor, and optionally treated to render residual gases harmless.

The amount of oxygen charged to the activating stage is adapted to the amount of nitrogen oxide charged thereto, so that the charge of $O_2$ per mole of $NO_2$ supplied is at least 0.08, suitably from about 0.1 to about 2, preferably from about 0.15 to about 0.30 mole $O_2$.

If NO or a mixture of NO and $NO_2$ is used instead, oxygen gas is charged to at least 0.60, suitably from about 0.65 to about 3, preferably from about 0.70 to about 0.85 $O_2$ per mole of NO charged. When nitric oxide is used, it is preferably charged in portions or continuously in a manner such that oxygen is supplied in portions or continuously prior to completion of the nitric oxide charge. In this way, activation is more uniform than when oxygen gas is not charged until all the nitric oxide has been supplied to the reactor.

The reactor can be designed for batchwise operation or for continuous operation, with continuous infeed, continuous flow through the pretreatment reaction zone, and continuous outfeed of the wood, e.g. chips and supply of gases thereto, from the pretreatment reaction zone.

In accordance with one embodiment, which is particularly suitable when nitric oxide is used during the pretreatment process, wood chips are contacted with an oxygen-containing gas, preferably substantially pure oxygen gas, before being contacted with nitrogen oxide.

Whether or not the chips are brought into contact with oxygen before being brought into contact with nitrogen oxide, the chips are suitably first subjected to a vacuum treatment, so that a subatmospheric gas pressure prevails in the pores within the chips, before the chips are brought into contact with nitrogen oxide and oxygen. This promotes a uniform reaction throughout the chips.

In order to obtain the most uniform possible reaction with the wood during the pretreatment, the pretreatment is suitably carried out at atmospheric pressure or at a pressure below atmospheric, preferably at a subatmospheric pressure within the range from about 50 to about 95% atmospheric pressure, during the major part of the process.

It is particularly suitable to carry out the pretreatment in a continuously operating reactor provided with gas sluices. Preferably, at least 80 mole % of nitrogen oxide charged is introduced adjacent the infeed end of the reactor, while preferably at least 80 mole % of the oxygen is introduced adjacent the outfeed end of the reactor.

It is particularly suitable to supply nitric oxide in the proximity of the infeed end of a continuous activating stage. It is also suitable in this respect to supply a certain amount of oxygen gas, so as to obtain a drop in gas pressure due to chemical reactions in the gas phase and with the wood. In order to obtain the best possible activation and utilization of the nitrogen oxide charged, and the least possible emissions and difficulty in rendering unconsumed nitric oxide and nitrogen dioxide harmless, it is suitable in the case of a continuous activating stage that oxygen gas, preferably the major part of the oxygen supplied be introduced into a zone or a plurality of zones located adjacent the outfeed end of the reactor. Suitably the oxygen gas is supplied in a zone which is so located that the retention time of the advancing pulp is within the range from about 70 to about 100, suitably from about 80 to about 100, preferably from about 90 to about 100% of the total retention time in the activating stage.

It has also been found suitable to reduce the temperature of the wood, e.g. the chips, during a late stage, for example after from 50 to 80% of the activating time has passed. The temperature is advantageously brought to less than 40° C., for example from 10° to 35° C., suitably from 20° to 30° C. The retention time at a temperature below 40° C. is within the range from about 10 to about 90 minutes, preferably from about 15 to about 60 minutes. The wood, e.g. the chips, can be cooled indirectly, for example by cooling the gas phase or by introducing cold oxygen, for example liquid oxygen. Water can also be evaporated by lowering the pressure.

In order to illustrate this embodiment of the invention, tests were carried out in a rotating reactor having a volume of 6 liters and containing 800 grams of bone-dry spruce chips having a solids content of 51%. The chips were treated with 0.52 kilomoles NO per 1000 kg of bone-dry chips. The amount of oxygen gas supplied corresponded to 0.85 mole of $O_2$ per mole of NO charged. Each of the gases was charged in 5 portions for 7 minutes at 70° C. The temperature then increased to 73° C., and maintained at this level for 23 minutes. The gas phase then contained 1.1 millimole $NO+NO_2$ per liter of sample. The reactor was cooled with water to 25° C., and was permitted to rotate for a further 30 minutes. The amount of $NO+NO_2$ in the gas phase had then fallen to 0.25 millimole per liter.

The wood is suitably washed with water or an aqueous solution subsequent to the pretreatment. It has been found particularly suitable to use an acidic washing water containing nitric acid. An acidic washing water can be recovered for reuse after counterflow washing of the pretreated wood.

It has been found particularly suitable to flush out the pretreated wood from the reactor after the activating stage using water and/or an aqueous solution.

During the pretreatment, there is formed a small quantity of water-soluble compounds and a somewhat larger quantity of alkali-soluble compounds. Among these are some unknown compounds which have been found to contribute to stabilizing the carbohydrates of the wood. When the pretreated wood is treated with alkaline liquid prior to the sulphate pulping stage, the resultant washing solution is suitably charged to the sulphate pulping stage so that these compounds are utilized in the pulping stage of the process.

According to a preferred embodiment of the invention, no alkaline treatment is effected between the pretreatment stage and the sulphate pulping stage. Thus stabilizing compounds are first liberated in the sulfate pulping liquor used during the sulphate pulping stage.

In the process of the invention, the pretreatment stage is followed by sulfate pulping stage, preferably following directly after the pretreatment stage, pulping the wood chips at a higher temperature, within the range from about 110° to about 190° C., in the presence of an alkaline pulping liquor comprising sodium hydroxide and sodium sulfide, until cellulose pulp is produced. The sulfate pulping stage is entirely conventional, and can be conducted in one or in several stages. Useful methods are described in Rydholm *Pulping Processes*, Interscience Publishers, New York, 1965 and for example, described in U.S. Pat. No. 4,113,553, patented Sept. 12, 1978.

The pulping liquor can be prepared by dissolution of sodium hydroxide and sodium sulfide and optionally also sulfur and/or hydrogen sulfide in water. White liquor is normally used, but a portion of green liquor can also be added, preferably during an early period of the cook.

Normally, the amount of effective alkali required for the sulfate pulping stage of the invention is less than that normally required by from about 10 to about 30%, based on the dry weight of the wood, but the exact amount used will of course depend upon the type of wood and the desired degree of pulping.

A highly selective delignification is obtained if the sulfidity of the pulping liquor is low, within the range from about 15 to about 25%, but good results are also obtained at high sulfidities ranging from about 30 to about 50%. The preferred pH range is from about 10.5 to about 14.5.

Spent alkaline pulping liquor can be recirculated after replenishment of the amount of sodium hydroxide and sodium sulfide consumed.

In one embodiment, which is particularly advantageous with respect to recovery and recycling of the chemicals employed, the chips after the pretreatment with nitrogen oxide and oxygen are treated with a green liquor, of a composition corresponding to that normally obtained in a sulfate pulping process. Preferably, the green liquor is one recovered after combustion of a spent alkaline sulfate pulping liquor from a sulfate pulping process carried out at a high sulfidity, i.e., from about 30 to about 50%, or a spent liquor from a polysulfide pulping from about 30 to about 50%, or a spent liquor from a polysulfide pulping process.

A green liquor which has been treated with carbon dioxide, for example, flue gases, to convert the sodium carbonate present partly or completely into sodium bicarbonate before the liquor can be used in this treatment.

The liquor supplied to this treatment can also be an aqueous sodium sulfide solution. Such a solution can be obtained from a smelt produced by combustion in a reducing atmosphere of spent liquors from the process of this invention, or from a smelt produced by combustion of spent pulping liquors from sulfate pulping or sulfide pulping processes with liquors containing sodium and sulfur compounds.

To enrich the treatment liquor with sodium sulfide, the sodium sulfide can be partially dissolved or leached from the smelt, separating it from the chemicals less soluble than sodium sulfide, such as sodium carbonate, or sodium carbonate can be crystallized out from an aqueous solution obtained by partial or complete dissolution of the smelt containing sodium carbonate and sodium sulfide. Sodium chloride in the smelt can also be removed by crystallization, thereby further concentrating the solution with respect to sodium sulfide.

The wood: pulping liquor ratio in the treatment stage can be widely varied. A suggested proportion is within the range from about 1 part wood to about 5 parts liquor, to about 1 part wood to about 1 part liquor.

The wood particles can be completely or only partly immersed in the pulping liquor; the pulping liquor can also be merely sprayed over a bed of the wood particles, which are not immersed in liquor at all. In a continuous process the particulate wood material can be held in a stationary bed, with the pulping liquor circulated through it, or the particulate wood material can be passed counter-currently to a flow of pulping liquor. In a batch process, the pulping liquor and particulate wood material would be held in a digester and the pulping liquor circulated through the bed by spraying it over the bed, and recirculating the liquor from the bottom of the vessel after it has percolated through the bed.

It is also possible to impregnate the particulate wood material with an excess of pulping liquor, which is then drained off before or after the pulping temperature has been reached. The pulping liquor that is removed can be recycled, for impregnation of another batch of wood particles.

The pulping is carried out by bringing the particulate wood material into contact with the pulping liquor and then gradually increasing the temperature, at a rate from 0.25° to 10° C. per minute until the desired pulping temperature in the stated range of from about 110° to about 190° C. is reached. If a high pulp yield is desired, it is generally desirable that the pulping temperature be within the range from about 145° to about 190° C.

The rate of reaction increases with the temperature. The higher the temperature, the less time required for the pulping reactions to take place. Consequently, the reaction temperature and the residence time are chosen to give the desired consumption of alkali in the course of the process.

The time required depends also on the type of wood, and the size of the wood particles. For thin chips of some wood types, the pulping can be complete in as little as from ten to thirty minutes at the pulping temperature. However, in most cases, the pulping time will be within the range from about thirty minutes to about two hours, although pulping times as much as four hours and higher can be used, especially if the pulping temperature is in the lower portion of the range.

In carrying out the sulfate pulping stage of the invention, the yield is normally held within the range from about 40% to about 60%, based on the dry weight of the wood charged. It is generally preferred to carry out the second pulping stage to a cellulose pulp yield within the range from 48 to 58%.

After the pulping process has been completed, the pulped wood may optionally be subjected to a mechanical treatment in order to liberate the fibers. If the pulping is brief or moderate, a defibrator, or disintegrator or shredder, may be appropriate. After an extensive or more complete pulping, the wood can be defibrated by blowing off the material from the digester, or by pumping.

The recovered pulp can easily be bleached in accordance with known methods, by treatment with chlorine, chlorine dioxide, chlorite, hypochlorite, peroxide, peracetate, oxygen or any combinations of these bleaching agents in one or more bleaching sequences as described in, for example, U.S. Pat. No. 3,652,388. Chlorine dioxide has been found to be a particularly suitable bleaching agent. The consumption of bleaching chemicals is generally markedly lower in bleaching pulps of the invention than when bleaching sulfate cellulose, due to the nitrogen oxide pretreatment.

The chemicals used for the pulping process can be recovered after the waste liquor is burned and subsequent to causticizing the carbonate obtained when burning the liquor.

The combination of pretreating the wood with oxygen and nitrogen oxide and the subsequent sulphate cooking of the wood affords a number of advantages. A main advantage is that wood consumption is drastically reduced, in comparison with previously known techniques in which additive chemicals are used for the purpose of reducing wood consumption. With price-equivalent quantities of additives, important advantages are gained when applying the invention in comparison with, for example, additions of anthraquinone. The method can also be used in combination with other additives, such as polysulphide and redox catalysts, for example.

Another advantage afforded by the invention is that the cellulose is depolymerized in the pulp to a lesser extent than in sulphate cooking the wood without the pretreatment stage. This enables the wood to be delignified to a greater extent during the pulping stage, thereby producing bleaching waste liquors of lower chlorine content and toxicity to be discharged to waste, and resulting in a reduction in the costs for bleaching chemicals.

A further advantage is that a lower sulphidity can be used in the sulphate pulping, which means a reduction in the various gaseous sulphur compounds discharged to atmosphere. These and other advantages afforded by the invention will be apparent from the working Examples set forth herebelow, which represent preferred embodiments of the invention.

EXAMPLES 1 TO 15

800 g of bone-dry pine wood (*Pinus sylvestris*) chips having an accurately determined solids content were charged to a reactor having a volume of 6 liters. The chips were carefully cleaned manually of knots and bark residues, and were subjected to an additional screening process which resulted in a fraction having a mean size of 5×30×20 mm. The reactor was evacuated to a pressure of 30 mm Hg, and then heated while rotating in a water bath, to a temperature of 3° C. below the reaction temperature given in Table I.

Nitric oxide (NO) and oxygen gas were introduced into the reactor vessel, each in five substantially equal portions, over a period of 10 minutes. The total amount of oxygen gas introduced was 0.80 mole $O_2$ per mole of nitric oxide charged. The temperature was then raised to the given reaction temperature, and the reactor vessel was permitted to rotate for a further length of time, so as to reach the intended reaction time. The time reported relates to the time at which nitric oxide was first introduced into the reactor vessel up to the time when the reaction was interrupted, this interruption being effected by introducing 4 liters of water into said vessel.

Aqueous solution was poured from the vessel after 20 minutes. Further aqueous solution was removed by centrifugation. The chips were washed in the centrifuge. The chips were then divided into four mutually equal parts by weight, said parts being passed into four autoclaves having a volume of 1.5 liters. Cooking liquor having a temperature of 80° C. was introduced into respective autoclaves, so as to obtain a wood: liquor ratio of 1:4 kg/liter, calculated per kg of the original, bone-dry chips with the water in the washed chips included in the liquid quantity. The amount of active alkali charged was 22%, calculated as NaOH on the original wood. The sulphidity was 20%. Heating was effected with a temperature rise of 0.6° C. each hour, from 80° C. to the final temperature of 170° C., by rotating the autoclaves in a polyglycol bath.

The cooks were interrupted after 60 to 180 minutes at a temperature of 170° C., by cooling the digesters with cold water. The pulp was then washed and screened. The quantity of shives obtained was 0.2 to 0.8 g per 100 g of bone-dry wood charged, and is included in the total yield reported, this yield also being calculated per 100 g of bone-dry wood charged. The kappa number and viscosity were determined in accordance with SCAN. The viscosity was determined after a preceding delignification at room temperature with chlorine dioxide in the presence of an acetate buffer having the pH 4.8.

Table I shows the interpolated values for total yield and intrinsic viscosity for pine pulp of kappa number 30 and 40. In the last three test series 0.05% anthraquinone was added to the sulphate cook calculated on the dry weight of the original wood. The other tests refer to sulphate cooks in which no redox catalysts were used.

TABLE I

| | | | Pretreatment | | At Kappa No. 30 | | At Kappa No. 40 | |
|---|---|---|---|---|---|---|---|---|
| Example No. | Wood Solids Content % | NO (kg mole/ 1000 kg) | Temp. (°C.) | Time (min) | Yield % | Viscosity ($dm^3$/kg) | Yield % | Viscosity ($dm^3$/kg) |
| Control A | 50 | 0 | 0 | 0 | 45.0 | 1055 | 46.4 | 1135 |
| Example 1 | 47 | 0.52 | 73 | 15 | 47.9 | 1110 | 49.3 | 1160 |
| Example 2 | 50 | 0.52 | 73 | 30 | 49.4 | 1110 | 51.0 | 1185 |
| Example 3 | 60 | 0.52 | 53 | 90 | 48.2 | 1110 | 49.9 | 1175 |
| Example 4 | 60 | 0.78 | 53 | 90 | 47.3 | 1100 | 48.7 | 1170 |
| Example 5 | 60 | 0.26 | 63 | 60 | 46.6 | 1040 | 48.3 | 1120 |
| Example 6 | 60 | 0.52 | 63 | 60 | 47.4 | 1100 | 49.2 | 1170 |
| Example 7 | 60 | 0.26 | 73 | 30 | 47.1 | 1080 | 48.4 | 1150 |
| Example 8 | 60 | 0.52 | 73 | 30 | 48.6 | 1070 | 50.3 | 1170 |
| Example 9 | 60 | 0.78 | 73 | 30 | 47.8 | 1065 | 49.6 | 1145 |
| Example 10 | 60 | 0.26 | 73 | 90 | 46.4 | 1070 | 48.5 | 1130 |
| Example 11 | 60 | 0.26 | 83 | 30 | 47.0 | 1035 | 48.1 | 1100 |
| Example 12 | 70 | 0.52 | 73 | 30 | 47.3 | 1050 | 49.4 | 1115 |
| Example 13 | 70 | 0.52 | 53 | 90 | 48.2 | 1070 | 49.6 | 1115 |
| Control B | 50 | 0 | 0 | 0 | 45.4 | 1070 | 48.3 | 1160 |
| Example 14 | 60 | 0.52 | 53 | 90 | 49.5 | 1115 | 51.0 | 1170 |
| Example 15 | 60 | 0.52 | 73 | 30 | 49.5 | 1085 | 50.9 | 1140 |

Control B (without pretreatment) and Examples 14 and 15 were carried out with an addition of 0.05% anthraquinone.

As shown in the Table, a marked improvement in pulp yield was obtained after the sulphate pulping as a result of pretreating pine chips with $NO/O_2$, both at the lower lignin level (Kappa number 30) and at the higher level (Kappa number 40). The greatest improvement in yield compared with Control A in which no pretreatment was undertaken was obtained when the chips had a solids content of 50%, which is the moisture content (50%) of the chips immediately after leaving the wood chipper. Under the conditions applied, the improvement in yield at Kappa number 30 was 4.4%, which corresponds to an about 9% saving in wood. Despite the higher yield, mainly the result of a higher content of glucomannan, the intrinsic viscosity was much higher than in the Controls.

A much smaller, although noticeably positive effect, of the pretreatment was obtained in the case of chips which had been placed in water prior to the pretreatment to increase the moisture content to 53% and lower the solids content to 47%. A similarly noticeable positive effect was also obtained with chips which had been allowed to dry in air at room temperature so as to obtain solids contents of 60 and 70%, respectively. Despite the fact that the process conditions were varied within wide limits, the results achieved were less favorable with the chips with a 60% solids content than those with a 50% solids content. The results show that the wood should not be dried prior to the pretreatment.

The results also show that an increase in the amount of nitric oxide charged from 0.26 to 0.52 g mole NO per 1000 g bone-dry wood resulted in a marked increase in yield. A significant improvement in yield, however, is also obtained with the smaller charge, which may be preferred when desiring pulps having a moderate hemicellulose content. The best result was obtained when treating at 73° C. for 30 minutes.

It is interesting to note, and surprising, that an increase in the amount of nitric oxide charged from 0.52 to 0.78 g mole per 1000 g bone-dry wood under the conditions used resulted in a significant impairment in yield. The Table also shows that the method can be used with wood which had been dried to a solids content of 70%, i.e., a 30% moisture content and confirms that drying results in a lower yield and a lower viscosity of the final pulp.

Under the applied process conditions, in which the chips are washed with water after the pretreatment in a manner which results in a not fully quantitative displacement of nitric acid formed the cooking time in the sulphate pulping stage for achieving a given Kappa number was not noticeably dependent on the pretreatment conditions. The time required was approximately the same as that required with wood which had not been pretreated.

On the other hand, the required pulping time was markedly shortened, both in the case of Control A and Examples 14 and 15, in which anthraquinone was added during the sulphate pulping stage. The pulping time to Kappa number 30 was reduced by 40 to 60 minutes, compared with corresponding Examples in which no anthraquinone was added. As shown in the Table, a high increase in yield was also obtained in these tests as a result of the pretreatment. When the pretreatment was carried out at temperatures of 53° C. and 73° C., a greatly improved viscosity was obtained, despite the increase in yield. This reflects a decreased depolymerization of the cellulose.

In addition to the Examples set forth above, further runs were made using another batch of chips of the same type. It was found in these runs that when increasing the pretreatment temperature to 105° C., and employing a treatment time of 5 minutes and 30 minutes, respectively, with a nitric oxide charge of 0.52 kg moles per 1000 kg wood, there was no increase in yield as a result of the pretreatment. In addition, the resultant viscosity was lower than that of the comparison pulp not subjected to the pretreatment, and there was obtained a strong increase in the amount of $NO+NO_2$ contained in the gas phase at the end of the pretreatment.

EXAMPLES 16 TO 19

The results of corresponding runs carried out as in Examples 1 to 13 but with industrial birch (*Betula verrucosa*) chips which had been cleaned and screened in the aforedescribed manner, are set forth in Table II.

In these Examples, the chips were pretreated at a solids content of 56%, 44% moisture content. The resultant yields and viscosity values are entered as a function of the Kappa number, and the values determined by interpolation to Kappa number 18 are given in the Table. This corresponds to a lignin content of the unbleached pulp normally considered suitable for manufacturing fully bleached sulphate pulp from birch.

TABLE II

| | | Pretreatment | | At Kappa number 18 | |
|---|---|---|---|---|---|
| Example No. | NO (g mole/ 1000 g) | Temp (°C.) | Time (min) | Yield (%) | Viscosity ($dm^3$/kg) |
| Control C | 0 | 0 | 0 | 53.0 | 1210 |
| Example 16 | 0.52 | 46 | 60 | 55.6 | 1220 |
| Example 17 | 0.52 | 46 | 30 | 54.0 | 1180 |
| Example 18 | 0.52 | 56 | 60 | 53.9 | 1220 |
| Example 19 | 0.52 | 56 | 30 | 55.4 | 1150 |

In Control C, in which no pretreatment was undertaken, there was obtained a total pulp yield of 53.0%, calculated on bone-dry wood. The yield was increased to 55.6% by pretreatment with a small quantity of nitric oxide and oxygen gas at 46° C. for 60 minutes. Despite an increased hemicellulose content, the viscosity was slightly higher than that of the comparison test, which implied a decrease in depolymerization of the cellulose. A lower yield and a slightly lower viscosity were obtained when the treatment time was shortened to 30 minutes.

When raising the pretreatment temperature to 56° C., only a moderate improvement in yield was obtained, in comparison with Control C, when the pretreatment time was 60 minutes. On the other hand, when shortening the time to 30 minutes, a greater improvement in yield was obtained, although at the price of a certain decrease in viscosity. A comparison between these results and those obtained with pine wood (Table I) shows that in order to obtain optimal results, a lower temperature should be used in the case of birch than that used with pine.

Similar runs carried out with aspen showed that a marked improvement in yield was also obtained in this case at a temperature of 46° C. and a treatment time of 60 minutes, whereas the effect was poorer when the temperature was increased by 10° C. under otherwise unchanged conditions.

Runs carried out with spruce showed that an increase in temperature from 56° to 83° C. during the pretreatment gave favorable results. Thus, the conclusion can be drawn that with hardwood, a lower temperature should be selected than that giving the greatest increase in yield with softwood.

EXAMPLES 20 AND 21

A control pulping without any pretreatment (Control D) was carried out by sulphate pulping 100 parts by weight industrial birch chips (*Betula verrucosa*) having a mean dimension of 6×23×20 mm and a solids content of 60.2% by weight. The alkali charge was 22% active alkali calculated as NaOH, and the sulphidity was 40%. The pulping time was 50 minutes at 170° C. and the wood: liquor ratio was 1:4 kg/liter. The temperature was increased at a rate of 0.6° C. per minute from a temperature of 80° C. to a temperature of 170° C. during the cook. The resultant pulp had the characteristics set forth in Table III.

In a first run, Example 20, carried out in accordance with the invention, 100 parts by weight of the same batch of industrial birch chips, having similar dimensions and moisture content, were pretreated under the conditions shown in Table III, and then pulped under the same conditions as the Control D. The pretreatment was carried out under agitation in a vessel with an addition of nitrogen dioxide ($NO_2$) corresponding to 0.65 kilomole/1000 kg dry chips. Prior to adding the nitrogen dioxide, the vessel containing the chips was evacuated to a pressure of 55 mm Hg, and brought to a temperature of 40° C. Nitrogen dioxide was then introduced into the vessel in portions over a period of ten minutes, and then oxygen gas was introduced into the vessel in a total quantity of 0.8 mole per mole of nitrogen dioxide, charged over a period of 3 minutes. After five further minutes had lapsed, the amount of nitrogen oxide ($NO+NO_2$) remaining in the gas phase was determined to be 0.1 millimole per $dm^3$, calculated as monomer.

The chips were then pulped under conditions of Control D, and the resultant pulp was analysed. The analysis results are set forth in Table III.

In Example 21, carried out in accordance with the invention under otherwise similar conditions as Example 20, the chips were leached with water for 12 hours at room temperature, after being treated with nitrogen dioxide, and the amount of active alkali was lowered to 20%. The resultant analysis is set forth in Table III.

TABLE III

| | Control D | Example 20 | Example 21 |
|---|---|---|---|
| Kappa No. | 19.5 | 19.5 | 19.3 |
| Screened yield % | 50.8 | 53.2 | 53.5 |
| Shives % | 0.8 | 0.8 | 0.8 |
| Total yield % | 51.7 | 54.0 | 54.3 |
| Viscosity $dm^3$/kg | 1357 | 1459 | 1465 |

The results show that, when proceeding in accordance with the invention, there is obtained an increase in yield of 2.3 to 2.6%, while the viscosity is improved by 7.5 to 8.0%, and the amount of nitrogen dioxide is kept low at the same time. It will also be seen from Example 21 that the amount of alkali charged can be reduced by 10% without impairing the result, which improves the process economy. The resultant increase in yield can be utilized to extend the pulping to a lower Kappa number, thereby decreasing the need of chlorine-containing bleaching chemicals in a subsequent bleaching process, with a reduction in environmentally harmful impurities as a result.

Having regard to the foregoing disclosure, the following is claimed as inventive and patentable embodiments thereof:

1. A process for reducing carbohydrate losses in the sulphate pulping of wood using sodium hydroxide and sodium sulfide, which comprises pretreating particulate wood in the presence of water with oxygen gas and nitrogen oxide for from about 3 to about 110 minutes at a temperature within the range from about 25° to 100° C., the amount of nitrogen oxide charged, calculated as monomers, being within the range from about 0.05 to about 1 kilomole per 1000 kg bone-dry wood, and then pulping the wood at a temperature within the range from about 110° to about 190° C. in the presence of an alkaline pulping liquor comprising sodium hydroxide and a sodium sulfide until cellulose pulp is produced.

2. A process according to claim 1, in which the nitrogen oxide is selected from the group consisting of $NO_2$, NO, $N_2O_4$, $N_2O_3$ and mixtures thereof.

3. A process according to claim 1 in which the pretreatment stage is directly followed by the sulfate pulping stage.

4. A process according to claim 1 in which the water is present during the pretreatment as water absorbed by the wood before contact with nitrogen oxide, the wood having a moisture content within the range from about 20 to about 60%.

5. A process according to claim 1 in which the nitrogen oxide is charged in a quantity, calculated as monomer, of from about 0.1 to about 0.8 kilomole per 1000 kg of bone-dry wood, and the pretreatment is effected for from about 5 to about 90 minutes at a temperature of from about 56° to about 85° C., the process being so controlled that upon completion of the pretreatment at least 40 mole % of the nitrogen oxides charged, calculated as monomer, is present in the form of nitric acid or nitrate salt.

6. A process according to claim 1 in which the sulphate pulping process is carried out with an aqueous pulping liquor composed of sodium hydroxide and sodium sulfide of a sulphidity of from about 10 to about 30%.

7. A process according to claim 1 in which the wood is hardwood and the temperature range in the pretreatment is from about 25° to about 52° C.

8. A process according to claim 1 in which the wood is softwood and the temperature range in the pretreatment is from about 52° to about 95° C.

9. A process according to claim 1 in which the nitrogen oxide is nitrogen dioxide charged as substantially pure $NO_2$ or NO.

10. A process according to claim 1 in which the oxygen is supplied to the activating stage as pure oxygen gas or liquid oxygen or an oxygen-containing gas mixture containing from about 80 to about 100 mole % oxygen.

11. A process according to claim 1 in which the amount of oxygen charged to the activating stage is at least 0.08 up to about 3 moles $O_2$ per mole of $NO_2$.

12. A process according to claim 1 in which the amount of oxygen charged to the activating stage is at least 0.06 up to about 3 moles $O_2$ per mole of NO.

13. A process according to claim 1 in which the particulate wood is subjected to a vacuum treatment, so that a subatmospheric gas pressure prevails in the pores therewithin, before being brought into contact with nitrogen oxide and oxygen.

14. A process according to claim 1 in which the pretreatment is carried out at a subatmospheric pressure within the range from about 50 to about 95% atmospheric pressure during the major part of the process.

15. A process according to claim 1 in which during the pretreatment the temperature is reduced to less than 40° C. after from 40 to 80% of the activating time has passed, for a retention time at a temperature below 40° C. within the range from about 10 to about 90 minutes.

16. A process according to claim 1 in which the wood is washed with water or an aqueous solution subsequent to the pretreatment and before the sulfate pulping.

17. A process according to claim 15 in which the aqueous solution is an acidic aqueous nitric acid solution.

18. A process according to claim 1 in which the wood: pulping liquor ratio in the pulping stage is within the range from about 1 part wood to about 5 parts liquor, to about 1 part wood to about 1 part liquor.

19. A process according to claim 1 in which the sulfate pulping is carried out by bringing the particulate wood material into contact with the pulping liquor and then gradually increasing the temperature at a rate from 0.25° to 10° C. per minute until the desired pulping temperature in the staged range of from about 110° to about 190° C. is reached.

* * * * *